US009611111B2

(12) United States Patent
Kawazoe et al.

(10) Patent No.: US 9,611,111 B2
(45) Date of Patent: Apr. 4, 2017

(54) SHEET FEEDING DEVICE AND IMAGE FORMING APPARATUS

(71) Applicant: FUJI XEROX CO., LTD., Tokyo (JP)

(72) Inventors: Yuki Kawazoe, Kanagawa (JP); Yoshinori Shuin, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/996,852

(22) Filed: Jan. 15, 2016

(65) Prior Publication Data

US 2017/0015512 A1 Jan. 19, 2017

(30) Foreign Application Priority Data

Jul. 17, 2015 (JP) ..... 2015-143241

(51) Int. Cl.

| | |
|---|---|
| ***B65H 1/04*** | (2006.01) |
| ***B65H 1/26*** | (2006.01) |
| ***B65H 3/34*** | (2006.01) |
| ***G03G 15/00*** | (2006.01) |
| ***B65H 7/20*** | (2006.01) |

(52) U.S. Cl.

CPC ..... *B65H 3/34* (2013.01); *B65H 1/04* (2013.01); *B65H 1/266* (2013.01); *B65H 7/20* (2013.01); *G03G 15/6529* (2013.01); *B65H 2405/1142* (2013.01)

(58) Field of Classification Search

CPC ..... B65H 1/04; B65H 1/266; B65H 2511/12

See application file for complete search history.

(56) References Cited

U.S. PATENT DOCUMENTS

| | | | | |
|---|---|---|---|---|
| 5,292,117 | A | 3/1994 | Takagi et al. | |
| 5,328,167 | A * | 7/1994 | Frank | B65H 1/04 271/147 |
| 8,702,093 | B2 * | 4/2014 | Hirahara | B65H 1/00 271/127 |
| 2015/0375950 | A1 * | 12/2015 | Tanaka | B65H 1/04 271/240 |

FOREIGN PATENT DOCUMENTS

| | | | |
|---|---|---|---|
| JP | 05-69950 | A | 3/1993 |
| JP | 2001-088970 | A | 4/2001 |
| JP | 2003-276859 | A | 10/2003 |
| JP | 2009-234706 | A | 10/2009 |

* cited by examiner

*Primary Examiner* — Luis A Gonzalez

(74) *Attorney, Agent, or Firm* — Sughrue Mion, PLLC

(57) ABSTRACT

A sheet feeding device includes a recording-medium container member that contains a recording medium; a restriction member that extends, at a downstream side of the recording-medium container member in a transporting direction of the recording medium, from one end side of the recording-medium container member in a width direction toward a location above the recording medium contained in the recording-medium container member, the restriction member including a restricting portion that restricts upward movement of the recording medium; and a guide member provided at the one end side of the recording-medium container member in the width direction and located upstream of the restriction member in the transporting direction of the recording medium, the guide member pressing the recording medium toward the other end side of the recording-medium container member in the width direction to adjust the transporting direction of the recording medium.

6 Claims, 7 Drawing Sheets

SHEET FEEDING DEVICE AND IMAGE FORMING APPARATUS

CROSS-REFERENCE TO RELATED APPLICATIONS

This application is based on and claims priority under 35 USC 119 from Japanese Patent Application No. 2015-143241 filed Jul. 17, 2015.

BACKGROUND

Technical Field

The present invention relates to a sheet feeding device and an image forming apparatus.

SUMMARY

According to an aspect of the invention, there is provided a sheet feeding device including a recording-medium container member that contains a recording medium; a restriction member that extends, at a downstream side of the recording-medium container member in a transporting direction of the recording medium, from one end side of the recording-medium container member in a width direction toward a location above the recording medium contained in the recording-medium container member, the restriction member including a restricting portion that restricts upward movement of the recording medium; and a guide member provided at the one end side of the recording-medium container member in the width direction and located upstream of the restriction member in the transporting direction of the recording medium, the guide member pressing the recording medium toward the other end side of the recording-medium container member in the width direction to adjust the transporting direction of the recording medium.

BRIEF DESCRIPTION OF THE DRAWINGS

An exemplary embodiment of the present invention will be described in detail based on the following figures, wherein.

DETAILED DESCRIPTION

Description of Image Forming Apparatus 1

An exemplary embodiment of the present invention will be described in detail with reference to the accompanying drawings.

Figure 1:
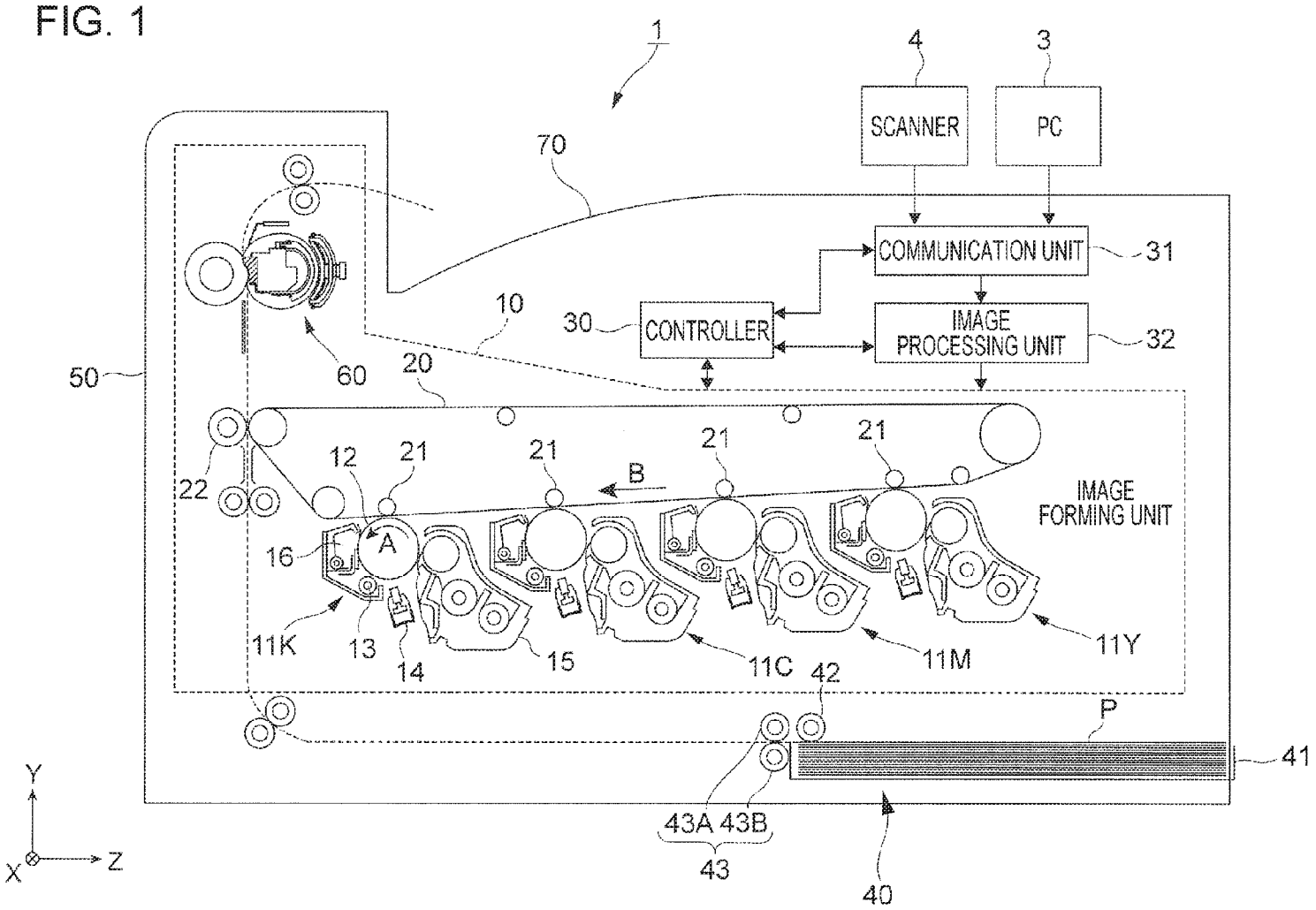
FIG. 1 illustrates an example of the structure of an image forming apparatus according to an exemplary embodiment.

FIG. 1 illustrates an example of the structure of an image forming apparatus 1 according to the exemplary embodiment. FIG. 1 illustrates the image forming apparatus 1 viewed from a front side F, that is, the side at which the image forming apparatus 1 receives instructions from a user or is operated by the user.

The image forming apparatus 1 illustrated in FIG. 1 is a so-called tandem color printer and includes an image forming section 10 which forms an image on the basis of image data; a sheet feeding section 40 that feeds sheets P toward the image forming section 10; a housing 50 that retains the image forming section 10 and the sheet feeding section 40 therein; and a sheet stacking section 70 on which the sheets P are stacked after images are formed thereon by the image forming section 10. The image forming apparatus 1 also includes a controller 30 that controls the overall operation of the image forming apparatus 1; a communication unit 31 that communicates with, for example, a personal computer (PC) 3 or an image reading device (scanner) 4 to receive the image data; and an image processing unit 32 that performs image processing on the image data received by the communication unit 31.

The sheet feeding section 40 includes a sheet feed tray 41, which contains a sheet stack, and a pick-up roller 42, which is an example of a sheet feeding member. The pick-up roller 42 is in contact with a downstream end portion of the top sheet P of the sheet stack in the sheet feed tray 41 in a transporting direction, and transports the sheet P toward the image forming section 10. The sheet feeding section 40 also includes a separation mechanism 43 including a feed roller 43A arranged so as to be rotatable and a retard roller 43B arranged such that rotation thereof is regulated. The separation mechanism 43 separates the sheets P transported by the pick-up roller 42 from each other and feeds the sheets P one at a time. In the sheet feeding section 40, the top sheet P of the sheet stack contained in the sheet feed tray 41 is picked up and transported toward a second transfer position of the image forming section 10.

The image forming section 10 includes four image forming units, which are yellow (Y), magenta (M), cyan (C), and black (K) image forming units 11Y, 11M, 11C, and 11K (hereinafter generically referred to as image forming units 11) that are arranged in parallel with predetermined spaces therebetween. Each image forming unit 11 includes a photoconductor drum 12 that forms an electrostatic latent image and carries a toner image, a charging device 13 that charges the surface of the photoconductor drum 12, and an exposure device 14 that irradiates the photoconductor drum 12 charged by the charging device 13 with light in accordance with the image data. Each image forming unit 11 also includes a developing device 15 that develops the electrostatic latent image formed on the photoconductor drum 12 and a cleaner 16 that cleans the surface of the photoconductor drum 12 after a transferring process.

The image forming section 10 also includes an intermediate transfer belt 20 on which toner images of respective colors formed on the photoconductor drums 12 of the image forming units 11 are superposed; first transfer rollers 21 that perform a first transfer process in which the toner images of the respective colors formed by the image forming units 11 are successively transferred onto the intermediate transfer belt 20; a second transfer roller 22 that performs a second transfer process in which the superposed toner images on the intermediate transfer belt 20 are simultaneously transferred onto the sheet P; and a fixing device 60 that fixes the image transferred onto the sheet P in the second transfer process to the sheet P.

The image forming apparatus 1 according to the present exemplary embodiment is a so-called color image forming apparatus which forms Y, M, C, and K color images on the sheet P. However, the image forming apparatus 1 is not limited to this, and may instead be, for example, a so-called monochrome image forming apparatus which forms monochrome images on the sheet P.

In the following description of the image forming apparatus 1, the direction from the front side F to a rear side R is defined as the X direction, the direction from the lower side to the upper side is defined as the Y direction, and the direction that crosses the X and Y directions and extends from the left side toward the right side when viewed from the front side F is defined as the Z direction.

Description of Sheet Feed Tray

The structure of the sheet feed tray 41 according to the present exemplary embodiment will now be described.

Figure 2:
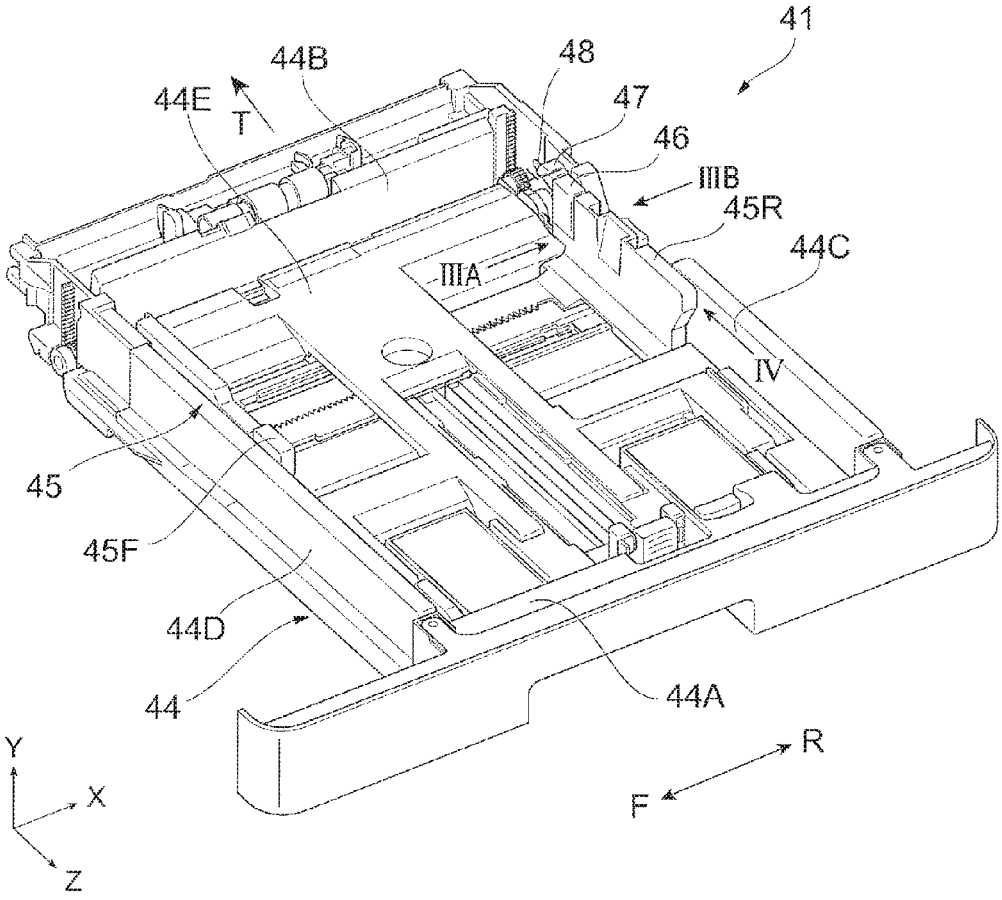
FIG. 2 is a perspective view illustrating an example of the structure of a sheet feed tray.

FIG. 2 is a perspective view illustrating an example of the structure of the sheet feed tray 41.

The sheet feed tray 41, which is an example of a sheet feeding device, includes a sheet container unit 44 that contains the sheet stack, which is a stack of sheets P. The sheet feed tray 41 also includes side guides 45 that are disposed in the sheet container unit 44 at one and the other ends of the sheet container unit 44 in a width direction of the sheet feed tray 41 that crosses a transporting direction T in which the sheets P are transported.

The sheet container unit 44, which is an example of a recording-medium container member, has the shape of a box with an open top and contains the sheets P. The sheet container unit 44 has a portion that projects from the housing 50 of the image forming apparatus 1 in the Z direction. The sheet container unit 44 includes a first side wall 44A that is located at the upstream side of the sheet feed tray 41 in the transporting direction and a second side wall 44B located so as to oppose the first side wall 44A at the downstream side of the sheet feed tray 41 in the transporting direction. The sheet container unit 44 also includes a third side wall 44C that is provided at the rear side R of the sheet feed tray 41 and connects the first side wall 44A and the second side wall 44B, and a fourth side wall 44D that is provided at the front side F of the sheet feed tray 41 so as to oppose the third side wall 44C and connects the first side wall 44A and the second side wall 44B. The sheet container unit 44 also includes a bottom plate 44E that is supported by a spring (not shown) provided at the downstream side in the transporting direction.

The sheet feed tray 41 is capable of being pulled out of the housing 50 of the image forming apparatus 1 in the Z direction. The bottom plate 44E of the sheet container unit 44 is connected to a moving mechanism, which is a known technical mechanism such as a rack and pinion, provided at the downstream end of the third and fourth side walls 44C and 44D in the transporting direction. When the sheet feed tray 41 is pulled out of the housing 50 of the image forming apparatus 1, the moving mechanism operates so as to move the bottom plate 44E downward against the pressing force applied by the spring.

Accordingly, the sheet feed tray 41 becomes capable of receiving new sheets P. Then, when the sheet feed tray 41 is pushed into the housing 50 in the −Z direction, the operation of the moving mechanism is canceled so that the bottom plate 44E is moved upward around the downstream side in the transporting direction by the pressing force applied by the spring. Accordingly, the sheet stack in the sheet feed tray 41 also moves upward, and the pick-up roller 42 disposed in an upper section of the sheet feed tray 41 comes into contact with the top sheet P of the sheet stack and transports the sheet P.

The side guides 45 include a side guide 45R provided at the rear side R of the sheet feed tray 41 and a side guide 45F provided at the front side F of the sheet feed tray 41. The side guides 45 are movable along the bottom plate 44E in the width direction of the sheet feed tray 41, and restricts movement of the sheet stack in the width direction.

The side guide 45R includes a sub-guide 46 that projects toward the front side F of the sheet container unit 44 and a sheet retaining pawl 47 that is located downstream of the sub-guide 46 in the transporting direction and that extends toward an upper section of the sheet stack in the sheet container unit 44. The side guide 45R also includes an oblique guide 48 that is provided on a lower portion of the sheet retaining pawl 47 and guides the sheet P that is transported.

Description of Sub-Guide

The sub-guide 46 included in the side guide 45R will now be described.

Figure 3A:
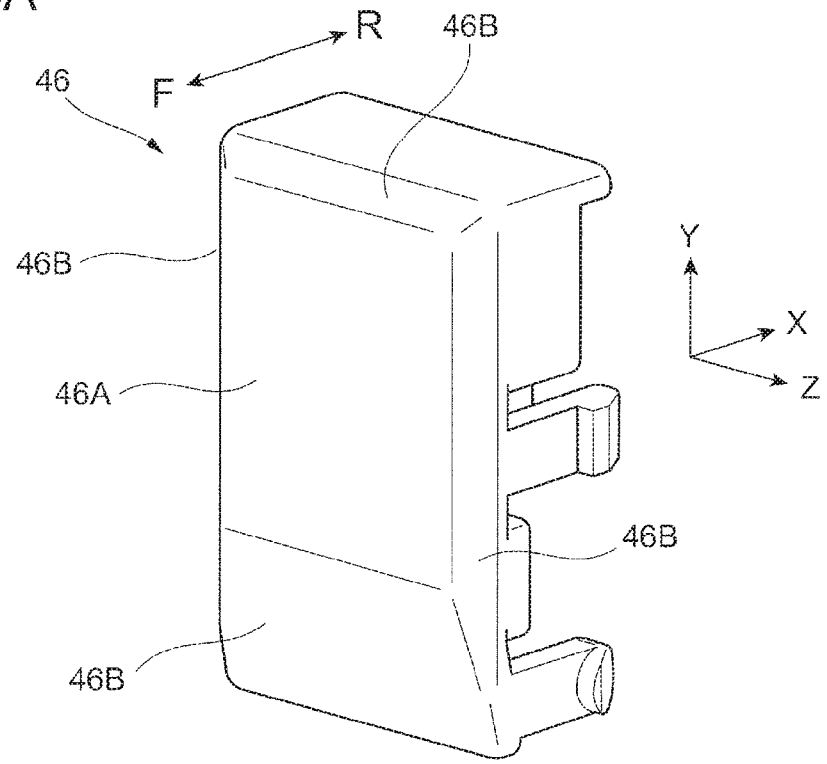
FIG. 3A is a perspective view of a sub-guide viewed in the direction of arrow IIIA in FIG. 2.
Figure 3B:
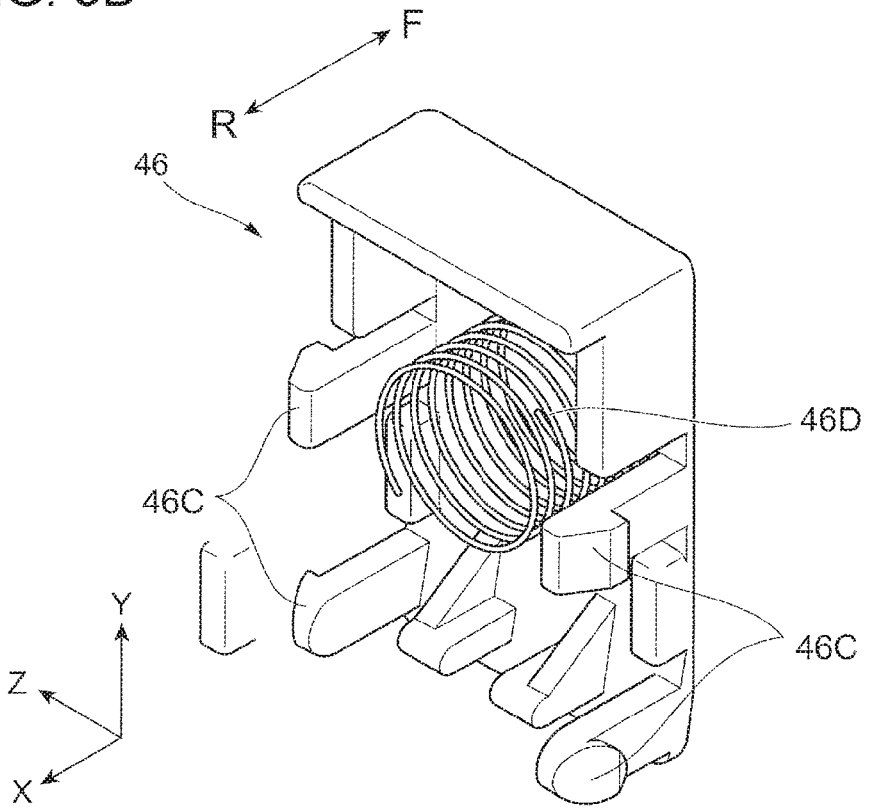
FIG. 3B is a perspective view of the sub-guide viewed in the direction of arrow IIIB in FIG. 2.
Figure 4:
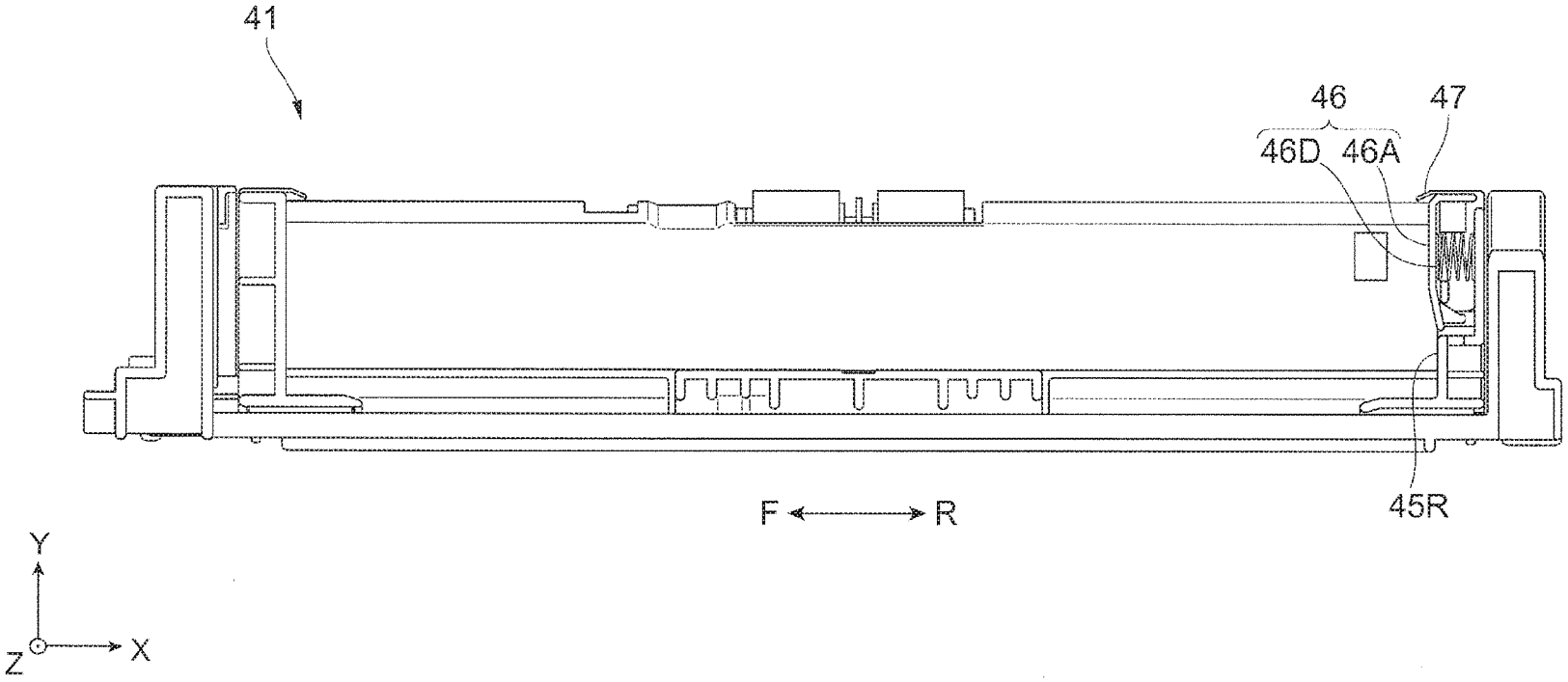
FIG. 4 is a plan view of the sheet feed tray in which the sub-guide is viewed in the direction of arrow IV in FIG. 2.

FIG. 3A is a perspective view of the sub-guide 46 viewed in the direction of arrow IIIA in FIG. 2, and FIG. 3B is a perspective view of the sub-guide 46 viewed in the direction of arrow IIIB in FIG. 2. FIG. 4 is a plan view of the sheet feed tray 41 in which the sub-guide 46 is viewed in the direction of arrow IV in FIG. 2.

In FIGS. 3A and 3B, components of the sheet feed tray 41 other than the sub-guide 46 are omitted.

As illustrated in FIG. 3A, the sub-guide 46, which is an example of a guide member, has a contact surface 46A that comes into contact with the top sheet P of the sheet stack in the sheet container unit 44 and adjusts the transporting direction of the sheet P.

The sub-guide 46 also has curved surfaces 46B that extend upward, downward, leftward, and rightward from the contact surface 46A and that are curved toward the rear side R. The curved surfaces 46B prevent the sheets P from being caught by the sub-guide 46 when new sheet P are supplied to the sheet feed tray 41 or when the bottom plate 44E of the sheet container unit 44 is moved upward.

As illustrated in FIG. 3B, the sub-guide 46 includes plural snap-fit portions 46C having hook-shaped ends that extend from a side opposite to the side at which the contact surface 46A and the curved surfaces 46B are provided toward the rear side R of the sheet feed tray 41. The sub-guide 46 also has a spring 46D that extends from an upper portion of the surface opposite the contact surface 46A toward the rear side R of the sheet feed tray 41.

The side guide 45R has plural opening portions (not shown) having openings, and the snap-fit portions 46C extend through the openings in the opening portions such that the side guide 45R supports the sub-guide 46. The contact surface 46A receives a pressing force from the spring 46D disposed between the sub-guide 46 and the side guide 45R in a direction toward the front side F of the sheet feed tray 41. As illustrated in FIG. 4, the sub-guide 46 projects from the side guide 45R toward the front side F at the position where the hook-shaped ends of the snap-fit portions 46C engage with the opening portions of the side guide 45R so as to restrict movement of the sub-guide 46. In the width direction of the sheet feed tray 41, the contact surface 46A of the sub-guide 46 is disposed above the uppermost position of the sheet stack that is receivable by the sheet container unit 44.

The sub-guide 46 comes into contact with the top sheet P of the sheet stack and guides the sheet P toward the side guide 45F. Therefore, even when the sheet P is spaced from the side guide 45R, the sheet P is prevented from being transported in a direction at an angle with respect to the transporting direction.

When the contact surface 46A is pushed toward the rear side R against the pressing force of the spring 46D, the sub-guide 46 is moved toward the rear side R and stopped at the position where the contact surface 46A aligns with the side guide 45R in the width direction of the sheet feed tray 41. Although a single sub-guide 46 is provided in the illustrated example, plural sub-guides 46 may be arranged in the transporting direction on the side guide 45R.

Description of Sheet Retaining Pawl

The sheet retaining pawl 47 will now be described.

Figure 5:
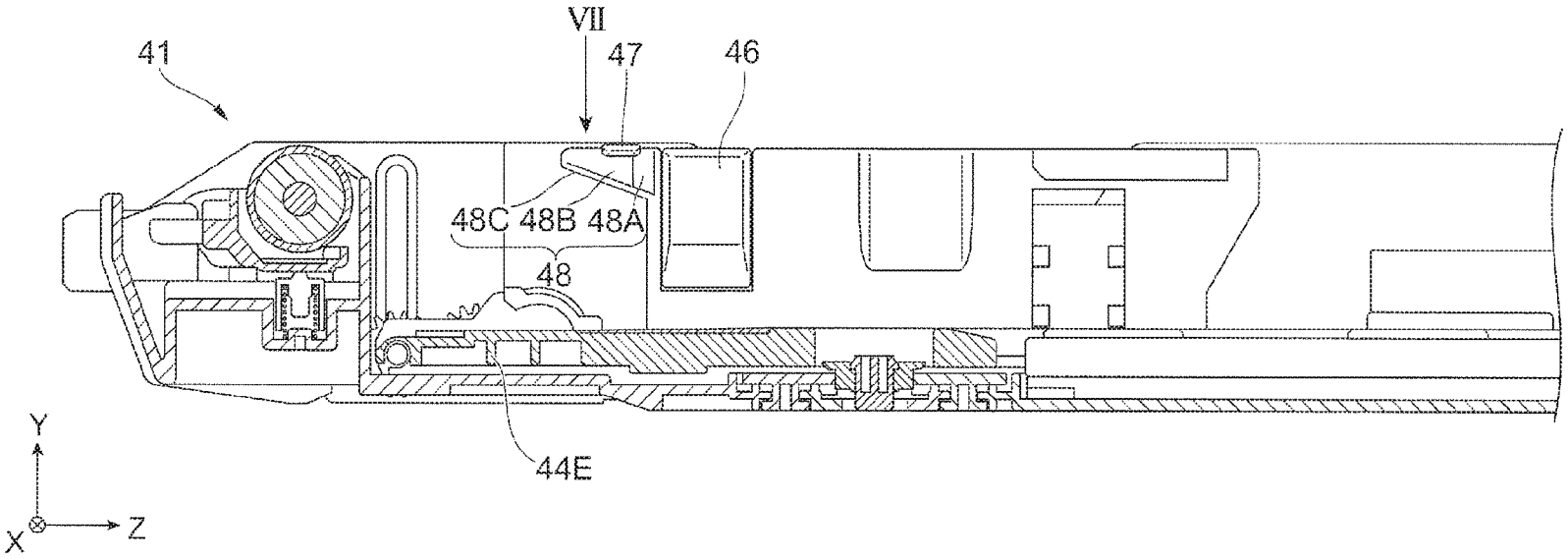
FIG. 5 is a front view of the sheet feed tray viewed in the same direction as the direction arrow IIIA in FIG. 2.
Figure 6A:
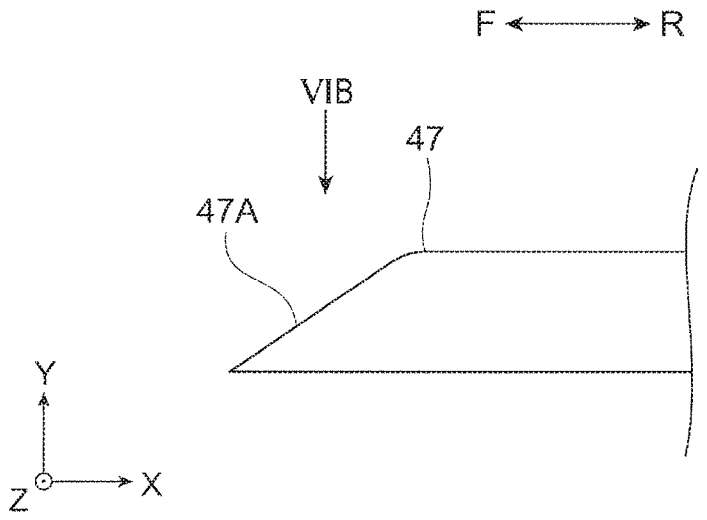
FIG. 6A is an enlarged view of a sheet retaining pawl.
Figure 6B:
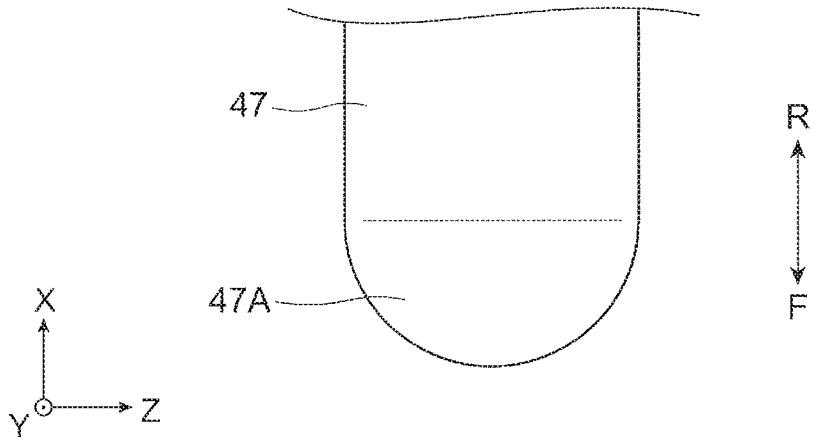
FIG. 6B illustrates the sheet retaining pawl viewed in the direction of arrow VIB in FIG. 6A.

FIG. 5 is a front view of the sheet feed tray 41 viewed in the same direction as the direction of arrow IIIA in FIG. 2. FIG. 6A is an enlarged view of the sheet retaining pawl 47, and FIG. 6B illustrates the sheet retaining pawl 47 viewed in the direction of arrow VIB in FIG. 6A.

The sheet retaining pawl 47, which is an example of a restriction member, is provided at a downstream end of the sheet container unit 44 in the transporting direction such that the downstream end thereof in the transporting direction does not interfere with the bottom plate 44E that moves in the up-down direction. The sheet retaining pawl 47 is disposed adjacent to the sub-guide 46. A bottom end portion of the sheet retaining pawl 47, which is an example of a restricting portion, comes into contact with the top sheet P of the sheet stack contained in the sheet container unit 44.

As illustrated in FIG. 6A, the sheet retaining pawl 47 extends toward the front side F and has a sheet guide surface 47A, which is inclined downward, at the top. When new sheets P are supplied to the sheet feed tray 41 from above, the sheet guide surface 47A guides the sheets P toward the sheet container unit 44 to prevent the supplied sheets P from being caught by the sheet retaining pawl 47. As illustrated in FIG. 6B, the sheet retaining pawl 47 has a U-shaped end portion. In addition to the sheet retaining pawl 47 provided on the side guide 45R, another sheet retaining pawl 47 may be provided on the side guide 45F at a position corresponding to the sheet retaining pawl 47 on the side guide 45R.

When the sheet feed tray 41 is inserted into the housing 50 of the image forming apparatus 1, the bottom plate 44E of the sheet container unit 44 moves upward, so that the sheet stack in the sheet container unit 44 also moves upward and approaches the sheet retaining pawl 47. At this time, even when the top sheet P of the sheet stack is curled, the sheet retaining pawl 47 comes into contact with the sheet P and restricts upward movement of the sheet P so that the sheet P is prevented from moving further upward. In this state, the sub-guide 46 presses the sheet P toward the side guide 45F and adjusts the transporting direction.

In the present exemplary embodiment, the sheet retaining pawl 47, which is disposed at a position close to a leading end of the sheet P that easily curls, restricts upward movement of the sheet p. In this state, the sub-guide 46 guides the sheet P toward the side guide 45F. Accordingly, even when the sub-guide 46 does not extend to an upper location so as to prevent the sheet P in a curled state from moving over the sub-guide 46, the sheet P may be aligned by the sub-guide 46. Thus, the sheet P is prevented from being transported from the sheet feed tray 41 in a direction at an angle with respect to the transporting direction.

From the viewpoint of preventing the sheet P from being transported from the sheet feed tray 41 in a direction at an angle with respect to the transporting direction, the sub-guide 46 may be disposed near the pick-up roller 42 and adjust the transporting direction of the sheet P. However, since the sheet retaining pawl 47 is provided at the downstream end of the sheet container unit 44 in the transporting direction, the sub-guide 46 is located away from the pick-up roller 42 toward the upstream side in the transporting direction by a distance corresponding to the sheet retaining pawl 47.

The sub-guide 46 may be provided at the downstream end of the sheet container unit 44 in the transporting direction, and the sheet retaining pawl 47 may be connected to the top end of the sub-guide 46. In this structure, however, since the sheet retaining pawl 47 is connected to the sub-guide 46 instead of the side guide 45R, the sheet retaining pawl 47 projects further toward the front side F of the sheet feed tray 4. In this case, there is a risk that new sheets P to be supplied to the sheet feed tray 41 will be caught by the sheet retaining pawl 47 and cannot be smoothly supplied.

In the case where a heavy sheet P, such as cardboard, is transported, there is a possibility that the sub-guide 46 will be pushed by the sheet P. In such a case, the sheet P is easily transported form the sheet feed tray 41 in a direction at an angle with respect to the transporting direction.

Accordingly, in the present exemplary embodiment, the oblique guide 48 is provided on a bottom portion of the sheet retaining pawl 47.

Description of Oblique Guide

The structure of the oblique guide 48 will now be described.

Figure 7:
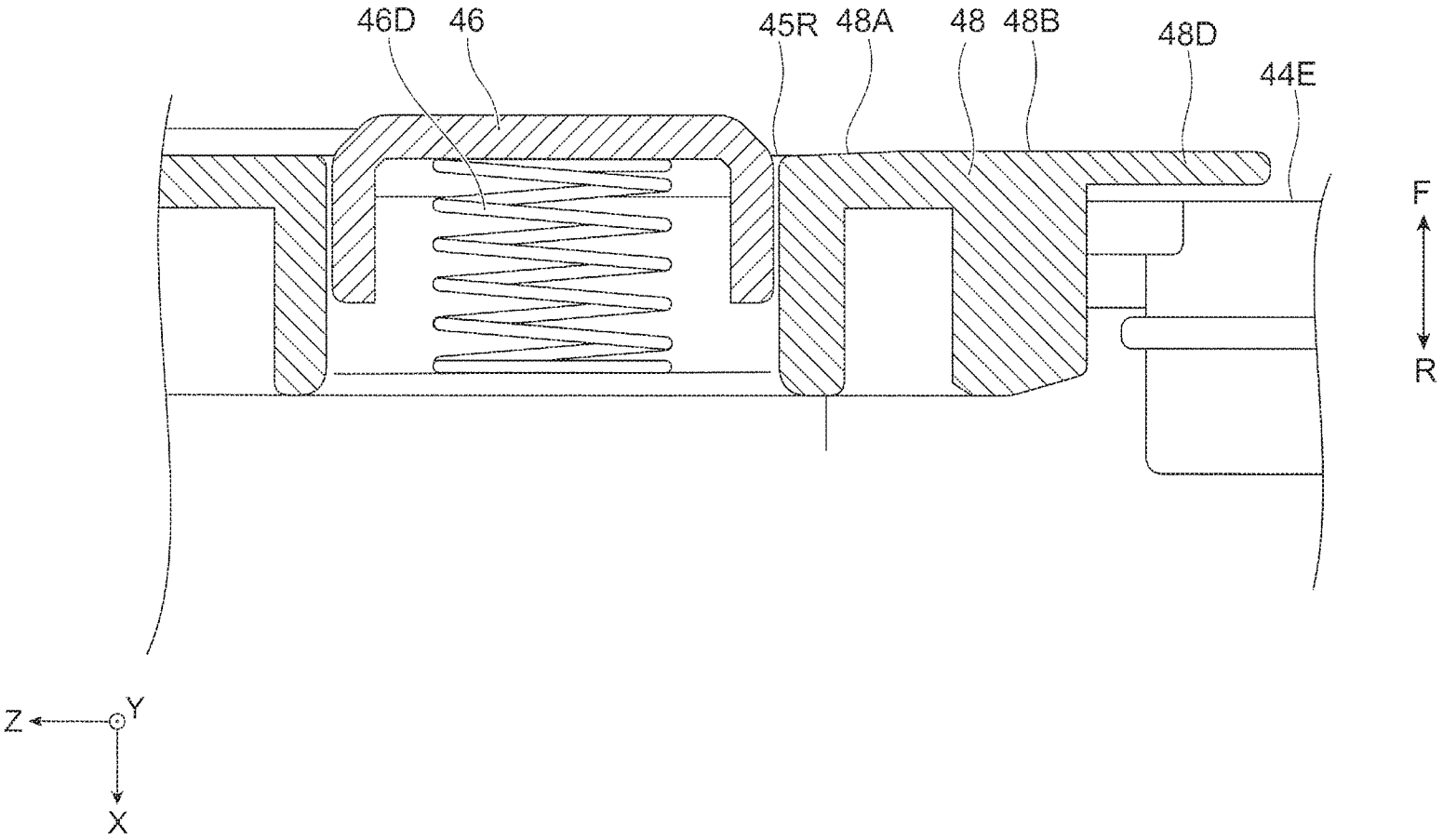
FIG. 7 is an enlarged view of an oblique guide viewed in the direction of arrow VII in FIG. 5.

FIG. 7 is an enlarged view of the oblique guide 48 viewed in the direction of arrow VII in FIG. 5. The structure of the sheet retaining pawl 47 is not shown in FIG. 5.

The oblique guide 48, which is an example of a projecting guide member, includes an oblique surface 48A that extends downstream in the transporting direction from the side guide 45R and is at an angle such that the downstream end thereof in the transporting direction is shifted toward the front side F. The oblique guide 48 also includes a skew restriction surface 48B, which is an example of a projecting surface. The skew restriction surface 48B is connected to the oblique surface 48A and extends downstream in the transporting direction. The oblique surface 48A may be at an angle of about 3° to 10° with respect to the transporting direction toward the front side F of the sheet feed tray 41.

The oblique guide 48 includes a thin plate 48D that is thin in the width direction and that is located downstream of the skew restriction surface 48B in the transporting direction. As illustrated in FIG. 5, the oblique guide 48 also includes a bottom end portion 48C that extends obliquely upward toward the downstream side in the transporting direction. The bottom end portion 48C is provided on a lower portion of the oblique guide 48 so as not to interfere with the bottom plate 44E that moves in the up-down direction.

The oblique guide 48 is connected to the bottom end portion of the sheet retaining pawl 47, and extends to a location above the bottom end portion of the sheet retaining pawl 47.

The skew restriction surface 48B projects from the side guide 45R toward the front side F of the sheet feed tray 41. The skew restriction surface 48B restricts movement of a portion of the top sheet P of the sheet stack in the width direction, the portion projecting downstream in the transporting direction from the sub-guide 46, and also restricts movement of a heavy sheet P that pushes the sub-guide 46 in the width direction.

Accordingly, the sheet P is prevented from being transported from the sheet feed tray 41 in a direction at an angle with respect to the transporting direction in a region downstream of the sub-guide 46 in the transporting direction. Since the skew restriction surface 48B is connected to the oblique surface 48A, new sheets P supplied to the sheet feed tray 41 are prevented from being caught between the sub-guide 46 and the oblique guide 48. Since the oblique guide 48 is connected to the sheet retaining pawl 47, even when the sheet P is curled, the sheet P does not move over the oblique guide 48 and is prevented from being transported from the sheet feed tray 41 in a direction at an angle with respect to the transporting direction.

In the present exemplary embodiment, the side guides 45 include the side guide 45F and the side guide 45R. However, the side guide 45F may be omitted, and the sub-guide 46 may be structured so as to align the sheets P by pressing the sheets P against the fourth side wall 44D of the sheet container unit 44.

Although the sheet feed tray 41 is configured to be pulled out of the housing 50 in the Z direction, the sheet feed tray 41 may instead be configured to be pulled out of the housing 50 in the X direction or the −X direction.

Although the sub-guide 46, the sheet retaining pawl 47, and the oblique guide 48 are provided on the side guide 45R, in the case where the side guides 45 are not provided on the sheet feed tray 41, they may instead be provided on the third side wall 44C.

Although the image forming apparatus 1 includes a single sheet feed tray 41, plural sheet feed trays 41 that are separate from each other may be arranged in plural stages.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A sheet feeding device comprising:

a recording-medium container member configured to contain a recording medium;

a restriction member that extends, at a downstream side of the recording-medium container member in a transporting direction of the recording medium, from one end side of the recording-medium container member in a width direction toward a location above the recording medium contained in the recording-medium container member, the restriction member including a restricting portion configured to restrict upward movement of the recording medium;

a guide member provided at the one end side of the recording-medium container member in the width direction and located upstream of the restriction member in the transporting direction of the recording medium, the guide member being configured to press the recording medium toward the other end side of the recording-medium container member in the width direction to adjust the transporting direction of the recording medium; and a projecting guide member provided on a lower portion of the restriction member and including a projecting surface that projects from the one end side toward the other end side of the recording-medium container member in the width direction, wherein the projecting guide member extends to a location above the restricting portion of the restriction member.

2. The sheet feeding device according to claim 1, wherein the guide member is arranged so as to be adjacent to the restriction member in the transporting direction of the recording medium.

3. The sheet feeding device according to claim 1, wherein the restriction member is disposed at a downstream end of the recording-medium container member in the transporting direction of the recording medium.

4. A sheet feeding device comprising:

a recording-medium container member configured to contain a recording medium;

a restriction member that extends, at a downstream side of the recording-medium container member in a transporting direction of the recording medium, from one end side of the recording-medium container member in a width direction toward a location above the recording medium contained in the recording-medium container member, the restriction member including a restricting portion configured to restrict upward movement of the recording medium;

a guide member provided at the one end side of the recording-medium container member in the width direction and located upstream of the restriction member in the transporting direction of the recording medium, the guide member being configured to press the recording medium toward the other end side of the recording-medium container member in the width direction to adjust the transporting direction of the recording medium; and a projecting guide member provided on a lower portion of the restriction member and including a projecting surface that projects from the one end side toward the other end side of the recording-medium container member in the width direction, wherein the projecting guide member further includes an oblique surface that obliquely extends downstream in the transporting direction of the recording medium and toward the other end side in the width direction and that is connected to an upstream side of the projecting surface in the transporting direction of the recording medium.

5. An image forming apparatus comprising:

a recording-medium container member configured to contain a recording medium;

a restriction member that extends, at a downstream side of the recording-medium container member in a transporting direction of the recording medium, from one end side of the recording-medium container member in a width direction toward a location above the recording medium contained in the recording-medium container member, the restriction member including a restricting portion configured to restrict upward movement of the recording medium;

a guide member provided at the one end side of the recording-medium container member in the width direction and located upstream of the restriction member in the transporting direction of the recording medium, the guide member being configured to press the recording medium toward the other end side of the recording-medium container member in the width direction to adjust the transporting direction of the recording medium;

an image forming section configured to form an image on the recording medium that is transported;

a sheet feeding member configured the transport the recording medium from the recording-medium container member toward the image forming section; and a projecting guide member provided on a lower portion of the restriction member and including a projecting surface that projects from the one end side toward the other end side of the recording-medium container member in the width direction, wherein the projecting guide member extends to a location above the restricting portion of the restriction member.

6. An image forming apparatus comprising:

a recording-medium container member configured to contain a recording medium;

a restriction member that extends, at a downstream side of the recording-medium container member in a transporting direction of the recording medium, from one end side of the recording-medium container member in a width direction toward a location above the recording medium contained in the recording-medium container member, the restriction member including a restricting portion configured to restrict upward movement of the recording medium;

a guide member provided at the one end side of the recording-medium container member in the width direction and located upstream of the restriction member in the transporting direction of the recording medium, the guide member being configured to press the recording medium toward the other end side of the recording-medium container member in the width direction to adjust the transporting direction of the recording medium;

an image forming section configured to form an image on the recording medium that is transported;

a sheet feeding member configured to transport the recording medium from the recording-medium container member toward the image forming section; and a projecting guide member provided on a lower portion of the restriction member and including a projecting surface that projects from the one end side toward the other end side of the recording-medium container member in the width direction, wherein the projecting guide member further includes an oblique surface that obliquely extends downstream in the transporting direction of the recording medium and toward the other end side in the width direction and that is connected to an upstream side of the projecting surface in the transporting direction of the recording medium.

* * * * *